United States Patent [19]

Furhata

[11] Patent Number: 4,793,723

[45] Date of Patent: Dec. 27, 1988

[54] MECHANISM FOR DETECTING END OF INK RIBBON IN A RIBBON CASSETTE

[75] Inventor: Tadashi Furhata, Suwa, Japan

[73] Assignee: Seiko Epson Corporation, Tokyo, Japan

[21] Appl. No.: 858,625

[22] Filed: May 2, 1986

[30] Foreign Application Priority Data

May 15, 1985 [JP] Japan ..... 60-71891[U]

[51] Int. Cl.[4] ..... B41J 35/36

[52] U.S. Cl. ..... 400/249; 400/208; 400/219.3; 400/234; 400/705.1; 242/57

[58] Field of Search ..... 400/207, 208, 208.1, 400/219, 219.1, 219.3, 219.4, 234, 249, 705.1; 242/57

[56] References Cited

U.S. PATENT DOCUMENTS

| | | | |
|---|---|---|---|
| 2,843,688 | 7/1958 | Masem | 242/57 X |
| 3,519,213 | 7/1970 | Hofmann et al. | 242/57 |
| 3,632,052 | 1/1972 | Read | 400/219.3 X |
| 3,642,225 | 2/1972 | Kakichi et al. | 242/57 X |
| 4,000,804 | 1/1977 | Zaltieri | 400/219.3 |
| 4,115,013 | 9/1978 | Hedstrom | 400/249 |
| 4,213,575 | 7/1980 | Firth, III et al. | 400/249 X |
| 4,407,593 | 10/1983 | Haftmann | 400/208 |

FOREIGN PATENT DOCUMENTS

| | | | |
|---|---|---|---|
| 0072777 | 4/1985 | Japan | 400/249 |

OTHER PUBLICATIONS

IBM Technical Disclosure Bulletin, "End-of-Ribbon Detector," Helinski, vol. 20, No. 6, Nov. 1977, pp. 2173–2174.

IBM Technical Disclosure Bulletin, "Limit Switch for Printer Carrier", Habich et al, vol. 23, No. 7B, Dec. 1980, pp. 3085–3086.

*Primary Examiner*—Ernest T. Wright, Jr.

*Attorney, Agent, or Firm*—Blum Kaplan

[57] ABSTRACT

The approaching end of usable ink ribbon which is being supplied from a cassette to a serial printer is signaled when a detector member which rides on used ink ribbon as it is wound onto the take-up spool of the cassette, reaches a predetermined distance away from the axis of the take-up spool and moves to project through an opening in the cassette. The wall of the cassette serves as a barrier to motion of the detecting member, with the opening in the wall establishing the predetermined diameter of the used ink ribbon. A detector on the frame of the printer responds to the presence of the detector member when it projects from the cassette.

4 Claims, 3 Drawing Sheets

MECHANISM FOR DETECTING END OF INK RIBBON IN A RIBBON CASSETTE

BACKGROUND OF THE INVENTION

The present invention relates to a mechanism for detecting the end of an ink ribbon. More particularly, the invention relates to a mechanism for mechanically detecting when the end of a cassette-contained ink ribbon is reached in a serial printing device.

In conventional mechanisms for detecting the end of the ink ribbon which is being used in a serial printer, typewriter, or the like, a transparent or reflective tape leader is fastened at the end of the ink ribbon to signal the approach of the end. Then, when the useful part of the tape has passed an optical sensor, the approach of the end is detected by utilizing the optical transparency or reflectivity of the leader tape.

However, serial printers and the like are required to be portable, compact and low in cost. Such devices use a power source of limited electric energy. Accordingly, it is not desirable to utilize an optical sensor which must be continuously supplied with electricity since the necessary power source is heavy, bulky, and expensive.

SUMMARY OF THE INVENTION

Generally speaking, the above problem is solved with the present invention by providing a member for detecting the end of an ink ribbon which responds to the increase in diameter of the used ribbon on the take-up spool. The member eventually reaches the level of an opening in the adjacent enclosing wall of the cassette which is positioned so as to correspond to a predetermined diameter of the ink ribbon winding on the take-up spool. When the detector member has moved to the opening, it drops therethrough, under the impulsion of a spring, and actuates a detector which signals that the end of the ink ribbon is near. The operator can then replace the ribbon before the quality of the printing deteriorates.

It is an object of the invention to provide a simple mechansim for positively detecting the approaching end of an ink ribbon in an ink ribbon cassette.

It is still another object of the invention to provide a mechanism for positively detecting the end of an ink ribbon which does not require the contstant supply of electricity.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
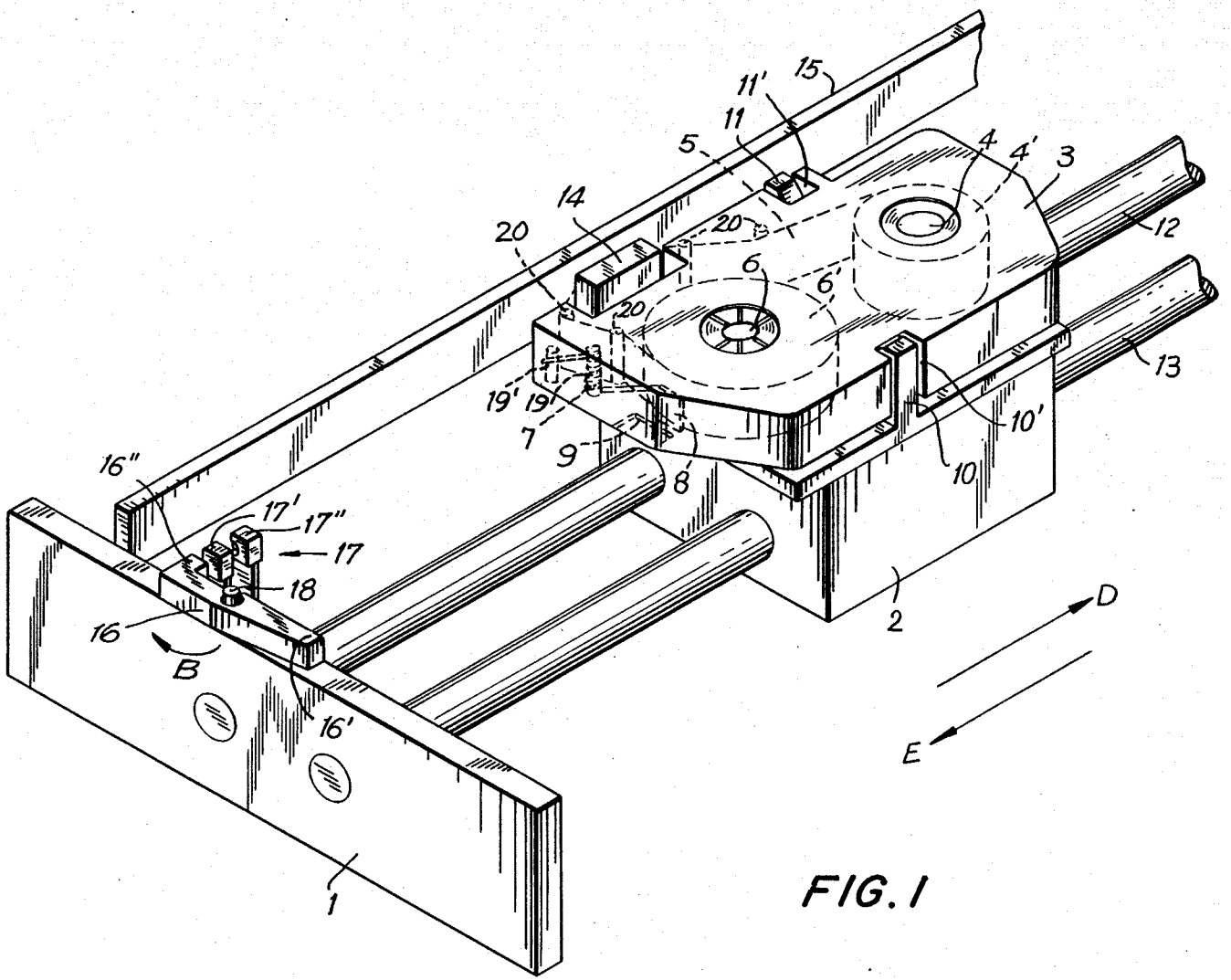
FIG. 1 is a perspective view showing a mechanism for detecting the end of an ink ribbon in accordance with the invention.

The construction of an illustrative embodiment of the present invention is depicted in FIGS. 1–4. While the illustrative embodiment is used to detect the end of a thermal ink ribbon in a thermal printer, it is to be understood that the principles of the invention are equally useful in other types of serial printers.

The printer of FIGS. 1–4 has a frame 1 having parallel shafts 12 and 13 which support a carriage 2 for motion in front of a stationary platen 15 in the directions of the arrows D and E. A thermal print head 14 is mounted on carriage 2 and urges an ink ribbon 5 towards a recording sheet (not shown) in front of the platen 15. An ink ribbon cassette 3 is mounted on carriage 2, being positioned thereon by upwardly projecting portions 10 and 11 of carriage 2, which are received in recesses 10' and 11' on opposite sides of cassette 3. Ink ribbon cassette 3 includes a supply spool shaft 4 and a take-up spool shaft 6 which are a predetermined distance apart. Take-up spool shaft 6 is driven by a motor means known in the art (not shown) to cause an ink ribbon 5 to unwind from spool shaft 4. Ink ribbon 5 then passes over a series of upright ink ribbon guide shafts 20 and in front of print head 14, after which it is taken up on spool shaft 6.

A detector member or plate 8 is carried at one end of a resilient coil spring 7 which is loosely supported on spring support shaft 19. Motion of the other end of coil spring 7 is stopped by a second shaft 19'; both shaft 19 and shaft 19' being supported on bottom wall 3' of the cassette 3. Coil spring 7 resiliently urges detector plate 8 in the direction of arrow F (FIG. 4), into contact with the body 6' of ink ribbon 5 which has been wound onto take-up spool shaft 6. Coil spring 7 also urges detector plate 8 axially downards, in the direction of arrow G (FIG. 4) into contact with the bottom wall 3' of cassette 3. Further downard motion is prevented by bottom wall 3' until the arrival of the end of ink ribbon 5 on take-up spool 6. As the diameter of ink ribbon body 6' increases on take-up spool shaft 6, however, detector plate 8 moves outwardly and approaches the edge of a rectangular hole 9 which is provided in cassette bottom wall 3'. When ink ribbon body 6' reaches a predetermined diameter, near or at the end of ink ribbon 5 as determined by the location of hole 9, detector plate 8 drops through the hole 9. When carriage 2 next returns to its home position at the left of frame 1 in FIG. 1, detector plate 8 contacts free end 16' of a detector lever 16. Detector lever 16 is pivotally mounted on a detector lever shaft 18 which projects upwardly from frame 1. The opposite end 16' of detector lever 16 brings movable contact 17' of a switch 17 into contact with a fixed contact 17''. Switch 17 is also mounted on frame 1.

Figure 2:
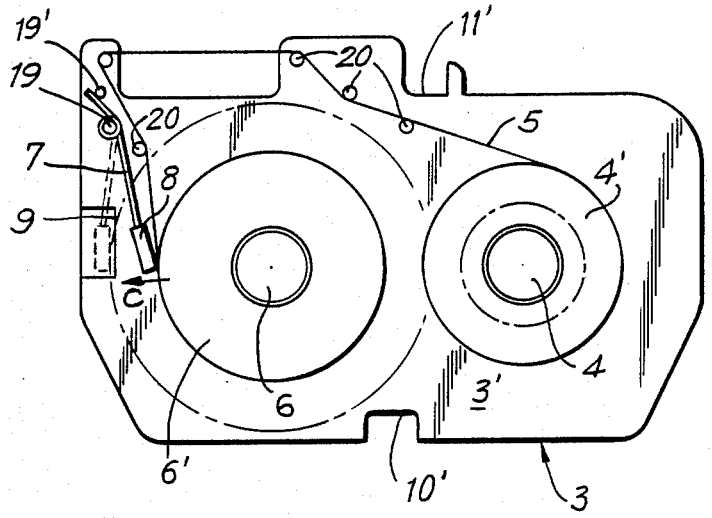
FIG. 2 is a schematic plan view of the detecting mechanism of FIG. 1 showing the manner of operation of the ink ribbon detecting mechansim.
Figure 3:
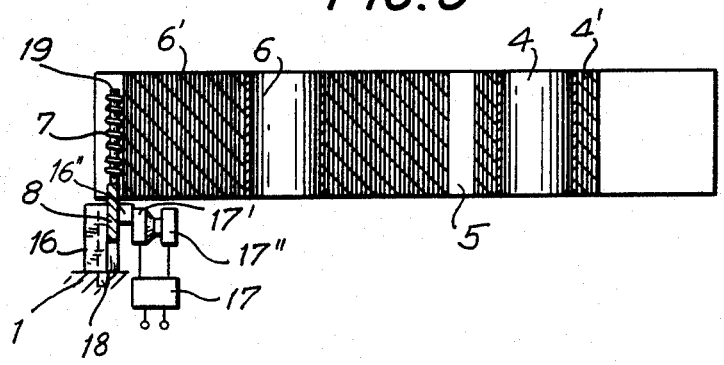
FIG. 3 is a schematic sectional view of the ink ribbon detecting mechansim of FIG. 1 showing a detector circuit which is actuated thereby.
Figure 4:
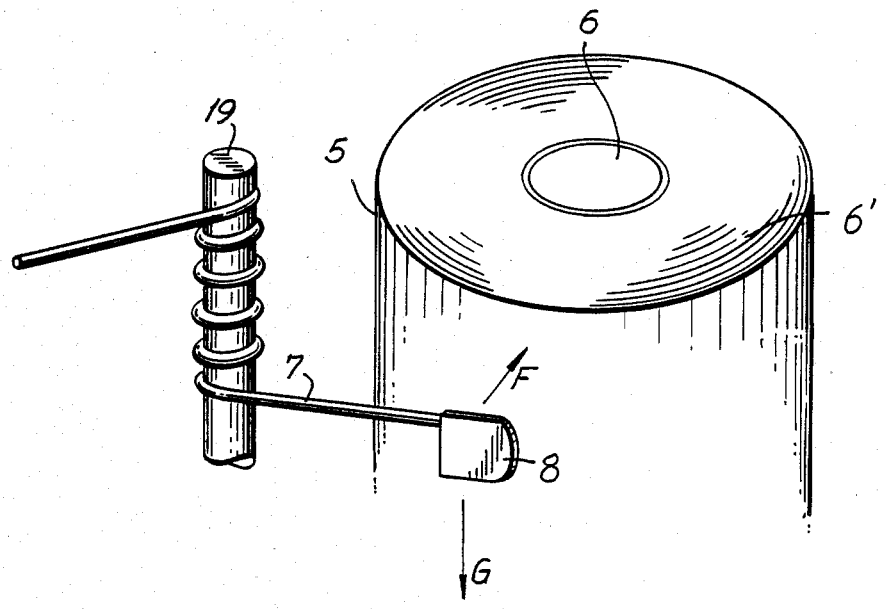
FIG. 4 is a schematic perspective view of portions of the ink ribbon and the detecting mechanism of FIG. 1, showing the directions of the forces generated by the spring which controls movement of the detector member.

Operation of the end detector mechanism is as follows: at first, when starting with a fresh cassette, all of ink ribbon 5, the unused ribbon body 4' except for the leading end, is carried on spool shaft 4. Every time that thermal print head 14 prints onto the recording sheet, the ink ribbon 5 is fed from supply spool shaft 4 to take-up spool shaft 6 and carriage 2 moves in the direction of the arrow D or the arrow E. After many repetitions of the foregoing operations, the bulk of the ink ribbon 5 is wound from spool shaft 4 to spool shaft 6, and the diameter of used ribbon body 6' gradually increases as shown in FIG. 2. Detector plate 8, urged into contact with used ribbon body 6' by resilient member 7, gradually moves outwards in the direction of arrow C towards hole 9. When the amount of ink ribbon 5 is at the end, e.g., when the predetermined diameter of used ribbon body 6' has been attained, detector plate 8 passes the edge of hole 9 and, urged by spring 7, falls into the hole 9 so that a portion projects out of the cassette 3. Then, as shown in FIGS. 1 and 3, when carriage 2 next returns to its home position, the movement carries the projecting portion of detector plate 8 against free end 16' of detector lever 16. As a result, detector lever 16 turns in the direction of arrow B around detector lever shaft 18, and the other end 16' of detector lever 16 actuates contact switch 17. The closing of switch 17 energizes a circuit for use in signaling that the ink ribbon 5 in cassette 3 is at the end of the ribbon 5 or, for example, to interrupt the operation of the printer, by means not shown. Removal of the used ink ribbon cassette 3, of course, releases contact switch 17 and the insertion of a new cassette 3 permits the resumption of printing. Whenever an end of an ink ribbon 5 is signaled, the same operation is repeated.

Although the invention has been described with reference to an embodiment of a mechanism for detecting the end of a thermal ink ribbon in a thermal printer, it is to be understood that the invention is not limited to this embodiment and that it can be used with other types of ink ribbons in printers other that thermal printers.

Thus it will be seen that, according to the present invention, a mechanism for detecting the end of an ink ribbon is provided which is mechanically simple and which requires little energy to operate.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A mechanism for detecting the end of an ink ribbon supplied from an enclosed cassette to a print mechanism, the cassette and the print mechanism being supported for travel on a frame of a printer and the ink ribbon being fed from a supply spool in the cassette and returned to a take-up spool therein, the take-up spool having an axis of rotation, the cassette having a wall adjacent to at least the take-up spool, the mechanism further comprising:

an opening in the wall of the cassette adjacent to the take-up spool;

a detector member in the cassette, the detector member including a movable surface contacting the outside layer of the ink ribbon on the take-up spool, the detector member being supported in the cassette for radial motion relative to the take-up spool and axial motion along an axis substantially parallel to the axis of rotation of the take-up spool, the detector member moving to project along said axis substantially parallel to the axis of rotation of the take-up spool through the opening in the cassette wall when the ink ribbon on the take-up spool has reached a predetermined level thereon; and resilient means for maintaining the detector member in contact with the ink ribbon on the take-up spool as the level changes, the resilient means urging the detector against the cassette wall and also urging the detector member to project through the opening in the cassette wall when the ink ribbon on the take-up spool has reached the predetermined level thereon.

2. The detecting mechanism of claim 1 and further comprising:

pivot means supported on the cassette proximate to the take up spool; and stop means supported on the cassette near to the pivot means, wherein the resilient means further comprises a coil spring pivotally mounted on the pivot means, one end of the coil spring urging the detector member against the ink ribbon, the other end of the coil spring being held against movement by the stop means.

3. The detecting mechansim of claim 1 wherein the detector member further comprises:

a detector lever mounted on the printer frame at one end of travel of the cassette, the detector lever being positioned to be contacted by the detector member when the detector member projects through the cassette; and switch means actuated by the detector lever when the detector lever it is contacted by the detector member.

4. The detecting mechanism of claim 1 wherein the detector member further comprises:

switch means for use in signaling the end of the ink ribbon, the switch means being supported on the frame of the printer in the path of travel of the detector member when the detector member projects through the opening in the cassette wall.

* * * * *

UNITED STATES PATENT AND TRADEMARK OFFICE

CERTIFICATE OF CORRECTION

PATENT NO. : 4,793,723

DATED : December 27, 1988

INVENTOR(S) : Tadashi Furuhata

It is certified that error appears in the above-identified patent and that said Letters Patent is hereby corrected as shown below:

Cover page, line 2, change "Furhata" to --Furuhata-- and line 5, change "Inventor: Tadashi Furhata" to --Inventor: Tadashi Furuhata--.

Signed and Sealed this

Fifteenth Day of August, 1989

*Attest:*

DONALD J. QUIGG

*Attesting Officer*

*Commissioner of Patents and Trademarks*